US007232369B2

(12) United States Patent
Karidis et al.

(10) Patent No.: US 7,232,369 B2
(45) Date of Patent: Jun. 19, 2007

(54) SYSTEM AND METHOD FOR PROVIDING HEATING, VENTILATION AND AIR CONDITIONING

(75) Inventors: George P. Karidis, Farmington Hills, MI (US); Christopher G. Kirchner, Ypsilanti, MI (US); Matthew A. Pettit, Livonia, MI (US)

(73) Assignee: SmithGroup, Inc., Detroit, MI (US)

( * ) Notice: Subject to any disclaimer, the term of this patent is extended or adjusted under 35 U.S.C. 154(b) by 187 days.

(21) Appl. No.: 10/817,077

(22) Filed: Apr. 2, 2004

(65) Prior Publication Data

US 2004/0198214 A1 Oct. 7, 2004

Related U.S. Application Data

(60) Provisional application No. 60/460,697, filed on Apr. 4, 2003.

(51) Int. Cl.
*F24F 7/00* (2006.01)

(52) U.S. Cl. ..... 454/274; 454/275

(58) Field of Classification Search ..... 454/274, 454/334, 275, 276, 283
See application file for complete search history.

(56) References Cited

U.S. PATENT DOCUMENTS

| | | | | | |
|---|---|---|---|---|---|
| 161,442 | A | * | 3/1875 | Rogers | 126/316 |
| 681,215 | A | | 8/1901 | Goll | |
| 2,339,629 | A | | 1/1944 | Fischer, Jr. | |
| 2,465,642 | A | * | 3/1949 | Lethieullier et al. | 454/274 |
| 2,936,692 | A | * | 5/1960 | White | 454/260 |
| 2,996,972 | A | | 8/1961 | Johansson | |
| 3,073,525 | A | * | 1/1963 | Cislo | 236/49.5 |
| 3,122,087 | A | | 2/1964 | Demuth et al. | |
| 3,946,647 | A | | 3/1976 | Lärkfeldt | |
| 3,986,850 | A | * | 10/1976 | Wilcox | 55/355 |
| 4,210,200 | A | * | 7/1980 | Vary | 165/98 |
| 4,506,830 | A | | 3/1985 | Francel | |
| 4,676,145 | A | * | 6/1987 | Allred | 454/276 |
| 4,729,292 | A | | 3/1988 | Marton | |
| 4,782,999 | A | | 11/1988 | Ishii et al. | |

(Continued)

OTHER PUBLICATIONS

Promotional material titled Vari-Disc Variable Volume Ceiling Diffusers, by Rickard Air Diffusion Inc., 7711 Welborn Street, Suite 110, Raleigh, NC 27615, undated, (4 sheets).

(Continued)

*Primary Examiner*—Derek S. Boles
(74) *Attorney, Agent, or Firm*—Foley & Lardner LLP

(57) ABSTRACT

An under-floor, perimeter-based heating ventilation and air conditioning pressurized air delivery system for use in a space includes a ventilation module, to be located in the floor, a multi-deflection linear bar grille covering the ventilation module, for diffusing the air entering the space, and a pair of apertured plates located below the grille, one plate moves relative to the other to either block more of the resultant apertures, so less air will flow, or to align the apertures, so more air will flow, all at nearly constant velocity and resultant plumage; nuances in aperture size or location allow one segment of the module to engage air flow on a lead-lag basis with respect to the other segments; air flow from the lead apertures induces air flow through a proximate under-floor heating module, to both increase its heat output and temper the ventilation air.

19 Claims, 5 Drawing Sheets

U.S. PATENT DOCUMENTS

| | | | | |
|---|---|---|---|---|
| 4,796,803 | A * | 1/1989 | Kelley | 236/49.4 |
| 4,821,628 | A * | 4/1989 | Sarazen et al. | 454/276 |
| 4,964,566 | A * | 10/1990 | Pugh et al. | 236/49.3 |
| 5,120,273 | A * | 6/1992 | Lin | 454/195 |
| 5,318,099 | A | 6/1994 | Zivalich, Jr. | |
| 5,338,254 | A | 8/1994 | Farrington | |
| 6,019,677 | A | 2/2000 | Demster | |
| 6,099,406 | A | 8/2000 | Demster | |
| 6,302,785 | B1 * | 10/2001 | McKinney et al. | 454/334 |
| 6,694,759 | B1 * | 2/2004 | Bash et al. | 62/180 |

OTHER PUBLICATIONS

Promotional material titled Underfloor Products, by Price Industries, 2975 Shawnee Ridge Court, Suwanee, GA 30024, bearing a designation of "2001", (5 sheets).

Promotional materials titled Access Floor Air Distribution Linear Floor Diffuser with Plenum, by Titus, 990 Security Row, Richardson, TX 75081, bearing a designation of "2000", (2 sheets).

Promotional materials titled Zebra Precision Air Valves, by Warren Technology, 2050 W. 73 St., Hialeah, FL 33016-9912, bearing a designation of "1994", (4 sheets).

Promotional materials titled Zebra Damper, by Warren Technology, 2050 W. 73 St., Hialeah, FL 33016-9912, bearing a designation of "Jan. 1997", (11 sheets).

* cited by examiner

SYSTEM AND METHOD FOR PROVIDING HEATING, VENTILATION AND AIR CONDITIONING

FIELD

The present invention relates generally to the field of heating, ventilation and air conditioning. The present invention more specifically relates to a heating, ventilation and air conditioning (HVAC) system which can be conveniently and readily installed in a number of locations, environments and configurations.

BACKGROUND

HVAC systems are used to provide heating, ventilation and/or air conditioning to an environment or space provided within building interiors. One type of HVAC system is an under-floor HVAC system. An under-floor HVAC system is used as an alternative to an overhead or in-wall system, providing for the passage of conditioned air beneath a floor (typically a raised, accessible floor system).

Current under-floor HVAC systems have several drawbacks as they often require: costly fans, coil and filter units; two separate systems for heating and cooling; a relatively large number of manual or automated individual floor diffusers that can be particularly cumbersome or ineffective for perimeter exposures; and/or partitioned under-floor plenums.

Accordingly, it would be advantageous to provide an HVAC system which can be conveniently and readily installed in a number of locations, environments and configurations including in particular under-floor applications. It would further be advantageous to provide an HVAC system that can provide for modularity in the construction and assembly of the system. It would further be advantageous to provide an HVAC system that can provide effective supply air plume characteristics under a variety of thermal load conditions. It would further be advantageous to provide an HVAC system that can activate air flow to different segments of the system in response to different thermal or ventilation needs. It would further be advantageous to provide an HVAC system that can be easily installed after the installation of a raised floor system and provides flexibility for relocation or reconfiguration. It would further be advantageous to provide an HVAC system that can reduce the number of components and floor plenum space involved and can provide convenient access for maintenance of its components. It would further be advantageous to provide an HVAC system that can employ a combination of floor-mounted, sill-mounted or other architecturally compatible air diffuser arrangements. It would further be advantageous to provide an HVAC system that can activate air flow to different segments of the system in response to different thermal or ventilation needs. It would be desirable to provide a system and method that provides any one or more of these or other advantageous features in a variety of configurations.

SUMMARY

One embodiment of the invention relates to a system and method that can modulate multiple supply air jets using an actuator and sliding aperture plates arranged in a horizontal plane. A single control actuator (such as a linear or linked rotary actuator) can modulate simultaneously the flow from a number of supply air jets provided by an under-floor air distribution system. The actuator can slide one movable aperture plate in a horizontal plane proximate a second fixed aperture plate to vary the net resultant aperture area exposed to a pressurized under-floor plenum. This configuration can maintain approximately constant air jet velocity and an elevated level of room air mixing through a large range of supply air flow.

Another embodiment of the invention relates to a system and method to modify the flow characteristics of a linear bar type supply air grille to enhance its performance when applied to an air distribution system such as perimeter building zones of an under-floor air distribution system or other suited applications. By arranging narrow air jet openings beneath and perpendicular to the bars of a continuous linear air supply floor grille, large amounts of room air can be induced by the jets, both perpendicularly between adjacent jets, and laterally into the small low-pressure zones created within each air jet above each of several grille bars spanning the jet opening. This room air induction can aid in achieving desired supply characteristics in supply air plumes.

A further embodiment of the invention relates to a system and method to passively induce room air with under-floor air jets to increase the heating output of an adjacent heating module (such as under-floor finned tubes located in isolated under-floor pockets). A passive induction effect can increase the heating output of the heating module while supply air to the room is warmed, without air passage connection between the under-floor air plenum and the pockets. In this application, vertical air supply jets flank the ends (and/or sides) of the heating module. The flanking air jets induce and help disperse into the room the convective heating plume from the heating module.

A further embodiment of the invention relates to a system and method of providing multi-variable control of multi-part air flows using aperture plates. Segmentally nuanced aperture plates (e.g., having apertures with differently shaped or spaced characteristics in different segments of the plates), in conjunction with controlling the relative lateral position of the plates can be used to control the flows of multiple sources of air through multi-step sequences or proportions. Apertures in one segment of the plates exposed to or provided near a heating source can open first in a heating mode, engaging apertures designed to accommodate minimum ventilation air, and then engage additional apertures designed to accommodate maximum cooling, all as the relative lateral movement of the plates is extended.

DETAILED DESCRIPTION

A heating, ventilation and air conditioning (HVAC) system which can be conveniently and readily installed in a number of locations, environments and configurations is disclosed. Generally, the system includes intermittent sections of variable-area, sliding-damper air supply outlets, optionally interspersed with and augmenting heating output of one or more heating sources. According to a preferred embodiment, an HVAC system is used to provide distribution for an under-floor air supply along perimeter zones in a space (such as a room) using one or more linear floor grilles.

The systems and methods disclosed provide an economical and functionally integrated means of serving the heating, ventilating and air conditioning requirements in zones by providing one or more cooling and ventilation modules (such as an under-floor air supply system using several supply air jets) in conjunction with one or more heating modules (such as under-floor pockets of finned heating tube or fan-powered plenum sections). Control of the system is generally effected by aligning and positioning two aperture plates provided with the cooling and ventilation module using a control actuator.

Figure 1:
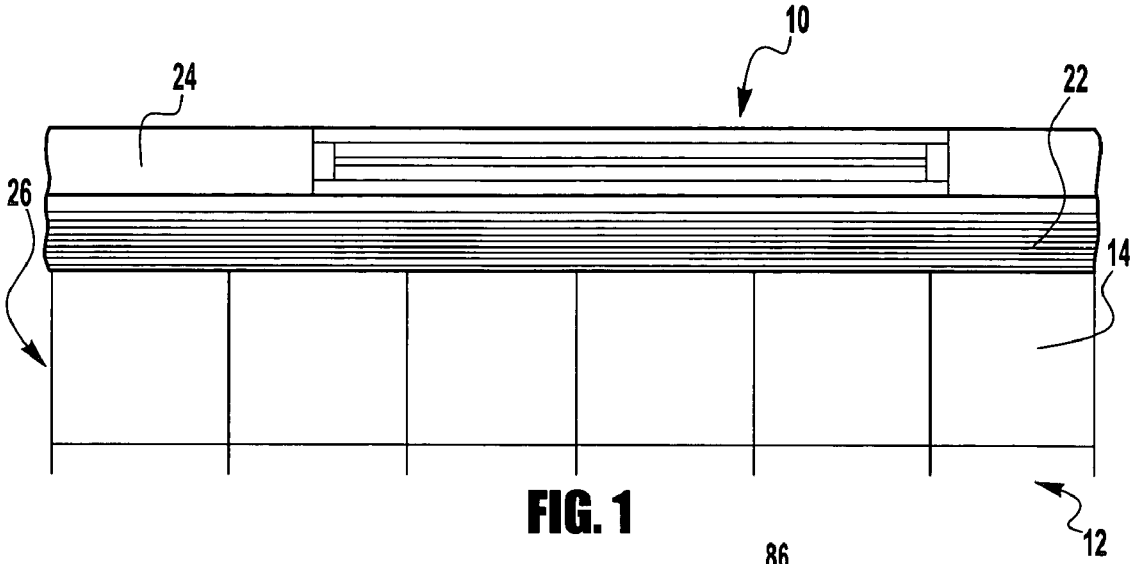
FIG. 1 is a top plan view of a heating, ventilation and air conditioning (HVAC) system according to an exemplary embodiment.

Referring to FIGS. 1–8, heating, ventilation and air conditioning (HVAC) systems and components thereof are shown according to exemplary embodiments. Shown in FIG. 1 is a system 10 that can be used to provide heating, ventilation and/or air conditioning to an environment or space (referred to generally as space 26). System 10 is shown installed in and used in conjunction with a raised floor system 12 in an interior environment. It should be noted at the outset that the systems and methods described can be installed and used in a variety of applications and environments including other interior applications not using a raised floor system, within walls and/or ceilings, exterior applications (i.e., providing air flow to outside spaces), provided along a perimeter of a space, provided centrally within a space, or any other desired configuration or arrangement.

Figure 4:
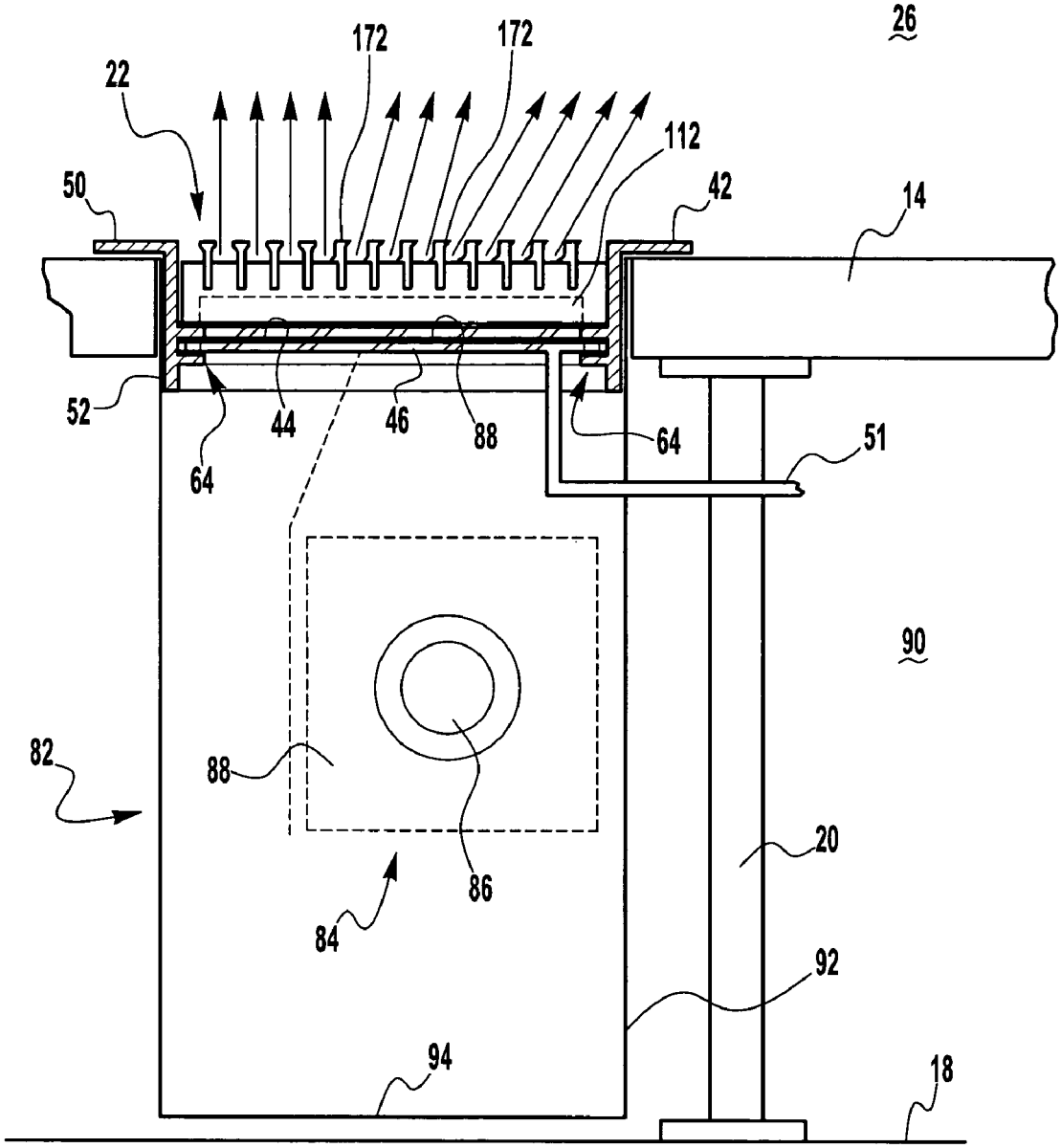
FIG. 4 is a cross section view of the HVAC system shown in FIG. 2, taken along the line 4—4.

System 10 is shown as installed and used in conjunction with a raised floor system 12. Floor system 12 can be any of a variety of conventional arrangements utilized within an environment or space 26 that provides a raised floor or support surface. As shown in FIG. 4, floor system 12 typically comprises a number of floor panels 14 (and/or other flooring surfaces, finished floor, carpeting, etc.) raised off of a sub-floor 18 and supported by a number of columns or posts 20. System 10 is supported by frame members 42 provided along opposing edges of an opening in floor panels 14. Frame members 42 have a horizontal portion 50 and a vertical portion 52. Frame member 42 is supported by floor panels 14 along horizontal portion 50. Vertical portion 52 is sized to receive a grille 22 and to keep grille 22 substantially flush with the top of finished floor panels 14 (which may or may not be finished, carpeted, etc.). According to a preferred embodiment, system 10 has a width approximately equal to the width of floor panel 14, allowing system 10 to be installed in floor system 12 in a modular fashion and minimizing the amount of alterations or adjustments needed to adjacent floor panels. According to alternative embodiments, the floor panel spacing can be adjusted to accept an HVAC assembly between integer rows of tiles or between tiles and an exterior wall, or the system can have any width or size desired (including fractional sizes of floor panels).

Figure 2:
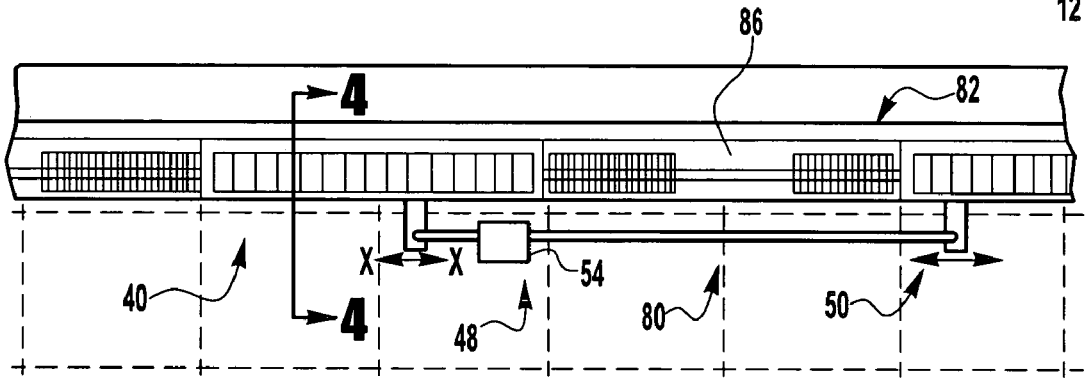
FIG. 2 is a top plan view of the HVAC system shown in FIG. 1, with a floor grille of the system removed.
Figure 3:
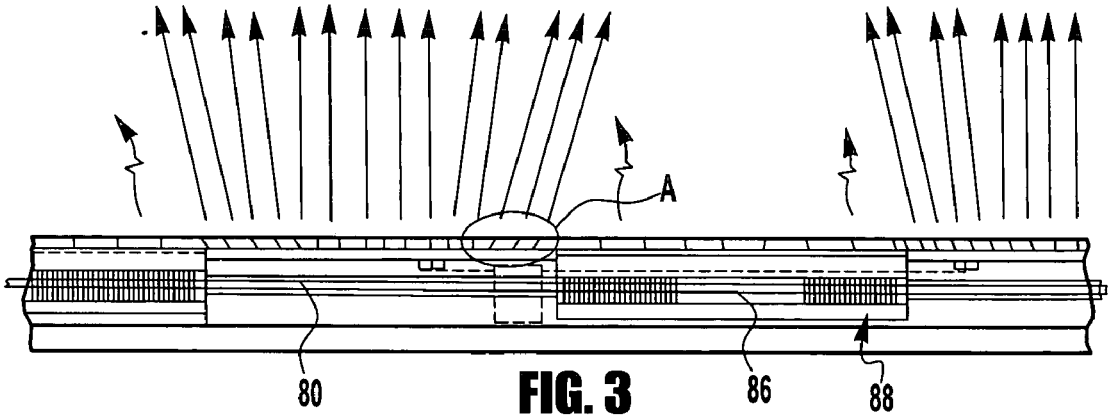
FIG. 3 is a side elevation view of the HVAC system shown in FIG. 1.

Referring to FIGS. 2–4, system 10 generally comprises one or more cooling and ventilation modules 40 and one or more heating modules 80. Cooling and ventilation module 40 controls air supply or air flow from an under-floor plenum or pressurized space 90 to environment 26 and also provides cooling air to environment 26. Heating module 40 generally provides heated air to environment 26.

A ventilation module 40 includes a first plate 44, a second plate 46 and an actuator 48. First plate 44 is fixed in position with respect to frame member 42. First plate 44 is provided with a plurality of apertures or openings 60. According to a particularly preferred embodiment, apertures 60 are rectangular in shape and are provided transverse or perpendicular to the length of system 10 (i.e., perpendicular to axis X—X shown in FIG. 2).

Second plate 46 is shown provided below first plate 44. Second plate 46 is moveable with respect to first plate 44 along axis X—X shown in FIG. 2 (e.g., slidable in a horizontal plane). Second plate 46 is also provided with a plurality of apertures or openings 62. According to a particularly preferred embodiment, apertures 62 are rectangular in shape and are provided transverse or perpendicular to the length of system 10 (i.e., perpendicular to axis X—X shown in FIG. 2). According to an alternative embodiment, the second plate can be provided above the first plate.

First plate 44 and second plate 46 are arranged such that second plate 46 can move to a number of positions between (and including) a first position and a second position with respect to first plate 44. In the first position, apertures 60 and 62 are aligned with respect to each other such that air flow from under-floor plenum 90 into space 26 will be minimally impeded (e.g., a fully open position). In the second position, apertures 60 and 62 are not aligned with respect to each other such that air flow is maximally impeded (e.g., a closed position). The result of changing the position of second plate 46 with respect to first plate 44 is that the alignment of apertures 60 and 62 changes, causing a change in the effective opening size or area through which air can flow (such as air jets). The differing opening sizes result in differing amounts of air flow from under-floor plenum 90 into space 26.

By sliding plate 46 with a series of apertures 62 (e.g. transverse slots) beneath a similar fixed plate 42, a control actuator 48 can modulate simultaneously the open area of a series of supply air jets (and thereby control the temperature). Each aperture pair is exposed to full plenum pressure regardless of active area (e.g., size), maintaining nearly constant velocity through a large range of air supply flow rates.

According to a preferred embodiment, apertures 60 and 62 can vary in size and spacing. As an example, the apertures provided toward the ends of plate 46 are larger in area than the corresponding apertures provided toward the ends of plate 44. As another example, the apertures of both plates can be larger in one or more segments. Also, aperture sizes can vary from plate to plate, and from module to module. Providing such variations enables system 10 to be usable in a range of applications. One such application is to inject a minimum supply airflow immediately adjacent heating modules 80. This configuration passively enhances heat output while tempering supply air, and the partial division of the aggregate supply air plume further reduces its vertical height. This configuration also regulates heating air flow in sequence with cooling air flows and disperses minimum air flow jets uniformly.

Figure 5:
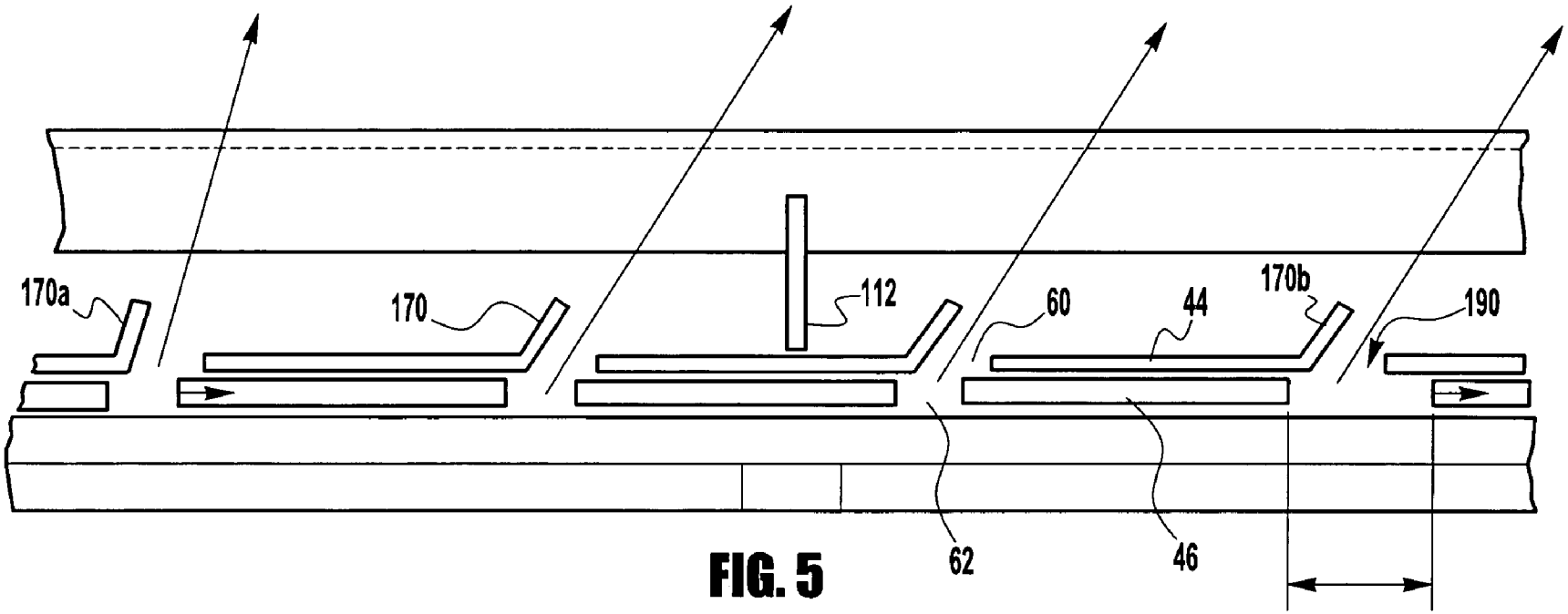
FIG. 5 is a detail view of section A shown in FIG. 3.
Figure 8:
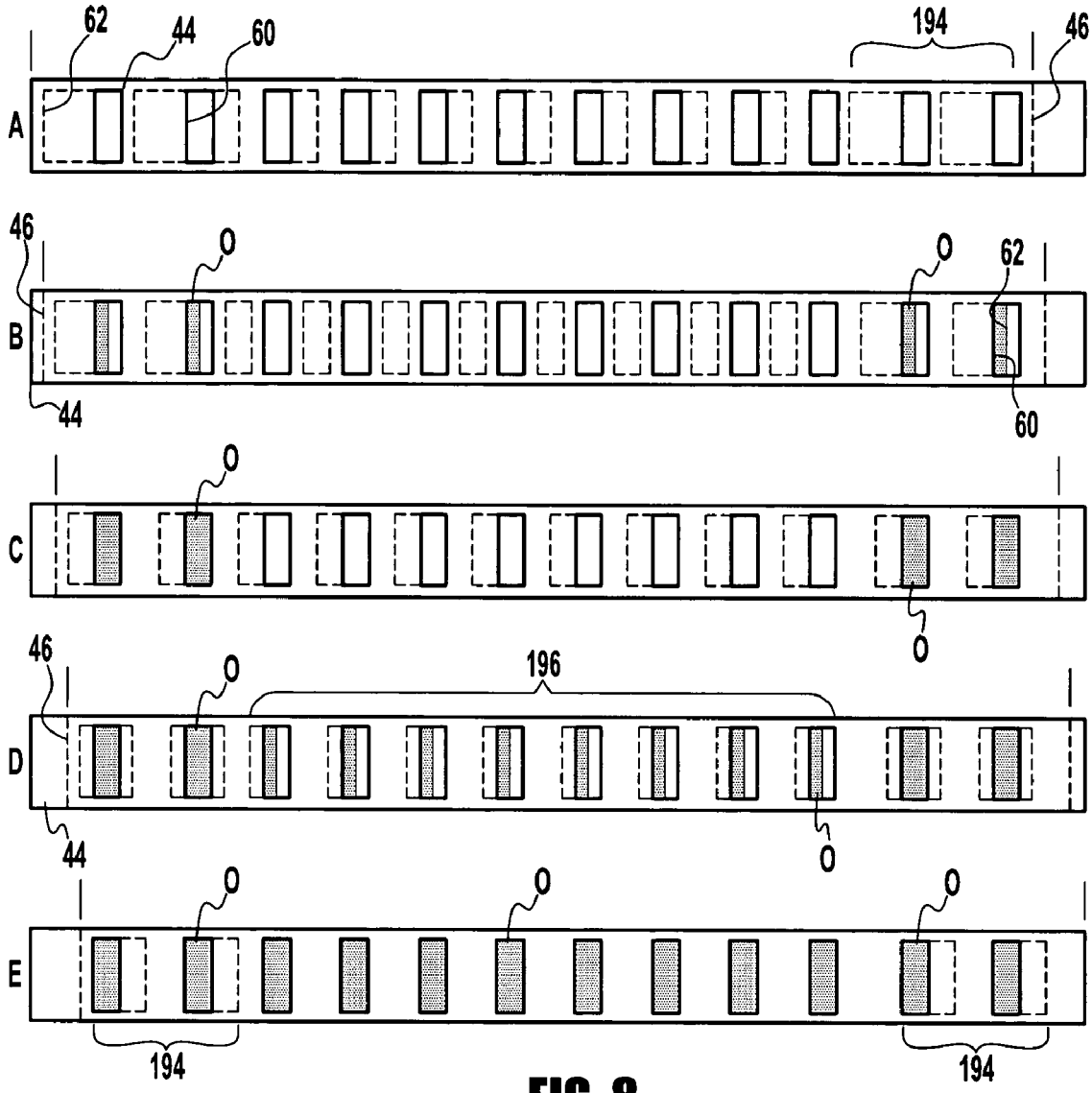
FIG. 8 is a series of top plan views of the aperture plates of FIG. 2 shown in various positions.

As best shown in FIGS. 5 and 8, segmentally nuanced aperture plates are shown having variations or nuances of apertures (such as different spacings and sizes) including variations between plate 44 and plate 46 as well as segments within the same plate (such as larger apertures near the ends of plate 46 and smaller apertures near the center of plate 46). Such variations or nuances in segments or portions of plates 44 and/or 46 allow one area or function to be effected while other areas or functions are inactive. For example, extra heating or cooling can be provided to an area having a higher thermal load, additional air flow can be provided in low circulation areas, heating modules can be induced or activated by the segmentally nuanced aperture places while limiting cooling air flow, etc.

The shape of the apertures can also be varied to alter characteristics of air flow. For example, the apertures can be modified by variously shaping the apertures, including parabolic or other shapes, to address specific capacity needs, low flow control needs, or increased plate overlap area for tighter shut-off. The aperture opening sizes can be increased to function properly with lower plenum design pressures or decreased for higher plenum design pressures. By creating apertures with differently shaped or spaced characteristics, and by controlling the lateral relative position of the plates, a control apparatus can be capable of sequencing the flows of multiple sources of air through multi-step sequences or proportions. For example, apertures in one segment of the plates exposed near a heating source can open first in a heating mode (as shown in FIG. 5 as opening 190, and FIG. 8 as shaded areas), engaging apertures designed to accommodate minimum ventilation air, and then engaging additional apertures designed to accommodate maximum cooling in conjunction with additional relative lateral movement of the plates.

As shown in FIG. 5, apertures 60 provided in first plate 44 may include one or more deflectors 170. Deflectors 170 may be provided at the same angles along first plate 44, or alternatively at varying angles along the first plate. For example, deflector 170*a* is provided at an angle which causes less deflection or re-orientation of air flow as compared to deflector 170*b*. This configuration may be desirable to cause diverging air jets, to enhance induction of room air and to lower the apex of the resultant plume of the supply air and room air mixture, etc.

Referring back to FIG. 4, one or more bearings 64 may be provided between first plate 44 and second plate 46 to assist in the relative movement between first plate 44 and second plate 46. According to a particularly preferred embodiment, bearing 64 is a linear bearing. According to alternative embodiments, other assemblies or materials may be provided between the first and second plate to facilitate relative movement. For example, Teflon® slide bearings, nylon slide bearings, ball or roller linear bearings, or friction reducing materials (such as dry lubricants) may be used.

An air seal 88 (or other gasket or "weather stripping" material) may be provided between first plate 44 and second plate 46 to control or limit leakage and to minimize the direct contact and wear between the parts.

Referring to FIGS. 2 and 4, actuator 48 is provided to cause relative movement of first plate 44 and second plate 46 relative to each other. Actuator 48 may be any of a variety of mechanisms which provide for such movement. According to a particularly preferred embodiment shown in FIGS. 2 and 5, actuator 48 includes a linkage 51 (such as a tie-rod or arm) coupled to a motor 54. Activation of motor 54 causes linear movement of linkage 51 (and movement of second plate 46). According to an alternative embodiment, the actuator includes a cable coupled to the second plate such that linear motion of the cable (effectuated by a motor) causes linear motion of the second plate (thereby changing the effective size of opening size or area through which air may flow). According to various other alternative embodiments, the actuator may include a rotary actuator, motor, piston, gear train, pneumatic actuator, etc. According to other alternative embodiments, the first and second aperture plates are configured to be adjusted in two directions with respect to each other. For example, the two aperture plates may slide relative to each other in two directions within the plane of the plates (such as perpendicular directions), etc.

One or more ventilation modules may be coupled to the same actuator 48 (see FIG. 2). According to a particularly preferred embodiment, actuator 48 is configured to include one or more links that allow for adjustment between connecting adjacent cooling and ventilation modules. An adjustment link may be used to rebalance or offset one ventilation module to receive more or less air than an adjacent ventilation module controlled by the same actuator.

A single actuator can control a relatively long section of ventilation modules with "plug-and-play" lengths of sheathed actuator cable (or rods or open cables). The cables may be run alongside and attached to individual ventilation modules (or linked in series), and provide for local adjustment of individual sections for air flow balancing. According to an alternative embodiment, a separate control rod may be run alongside and attached individually to multiple ventilation modules, as an alternative to connecting the extrusions end to end in series. Adjacent ventilation modules may also have removable links such that other actuators may be installed or relocated to suit room reconfiguration.

According to a particularly preferred embodiment, actuator 48 is commanded to an appropriate position (to control air jet opening sizes) by typical temperature controls such as a thermostat. According to an alternative embodiment, manual control of the actuator may be used in lieu of automated control, either for user-adjusted comfort or as an initial maximum flow balancing effort. According to another alternative embodiment, manual controls may be incorporated with automated control.

According to another alternative embodiment, air flow may be controlled by an axle parallel to and below the floor grille that rotates paddle-like dampers toward the grille's front edge to shut against the plenum pressure and towards the rear edge to expose more of the grille to plenum pressure.

Referring to FIGS. 2–4, heating module 80 includes a pocket 82 (or partition) and a heating element 84 provided in pocket 82. According to a particularly preferred embodiment, pocket 82 comprises four side walls 92 provided on four sides of heating element 84, and a plate 94 provided below heating element 84. A top portion or area 86 is open to allow heated air flow through grille 22 (see FIG. 2). According to an alternative embodiment a sheet metal partition may be installed on the interior edge of the heating element and each of two ends of the heating element. This arrangement would use the floor and an adjacent building wall as the other two partition walls.

According to the particularly preferred embodiment, heating element 84 comprises a pipe 86 through which hot water flows. Fins 88 are coupled along sections of pipe 86 in pocket 82 to assist in the heat transfer from the heated water in pipe 86 to air surrounding fins 88. As seen in FIG. 2, pipe 86 may extend along the entire length of system 10. However, fins 88 are provided on pipe 86 only in pocket 82. Pipe 86 may be insulated in areas outside of pocket 82. This configuration allows unfinned pipe (typically insulated) to pass under adjacent cooling sections in a straight line.

Heating modules 80 are provided along intermittent segments of system 10. Heating element 84 collects cool room air near an exterior wall 24 and draws it down into pocket 82. As the air is heated in heating element 84, it rises out into space 26.

Heating output of heating modules 80 may be passively induced with adjacent air jets to increase the heating output of heating module 80. For example, air supply jets provided on the ends and/or sides of the heating module induce and help disperse into the room the convective heating plume from heating module 80 (see FIG. 3).

According to an alternative embodiment, the actuator also may be linked to open a hot water control valve (not shown) to prevent the flow of hot water during cooling (i.e., configured to avoid simultaneous heating and cooling by the system). According to a further alternative embodiment, a single static side deflector/aperture deflector plate or a manually adjusted two plate deflector may be introduced to a conventional grille/plenum box (e.g. served by a conventional automatic damper and/or a duct connected to a fan terminal or other source of treated or conditioned air) to transform its performance characteristics to better suit specific under-floor air applications.

Figure 6:
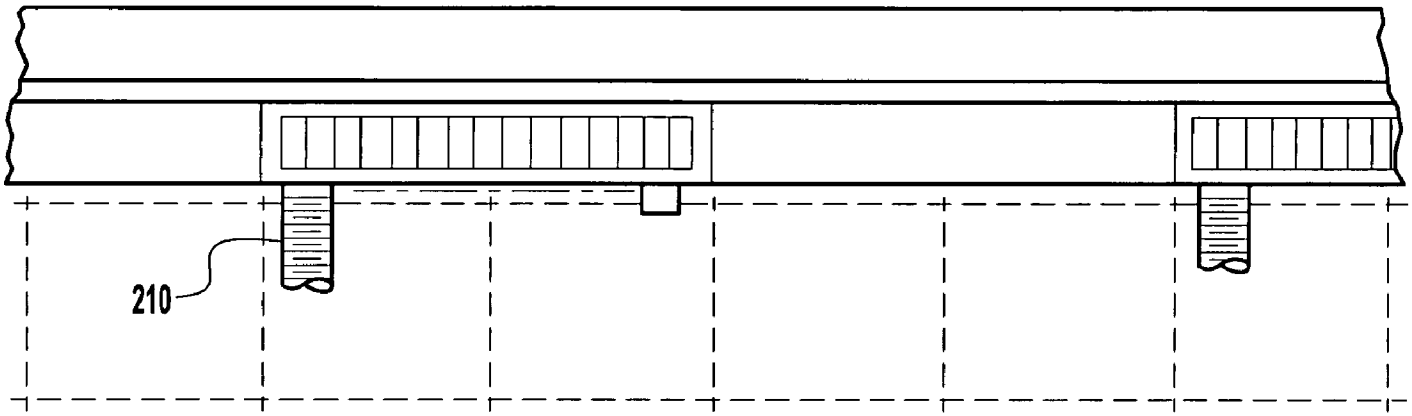
FIG. 6 is a top plan view of the HVAC system according to a second exemplary embodiment with a floor grille of the system removed.
Figure 7:
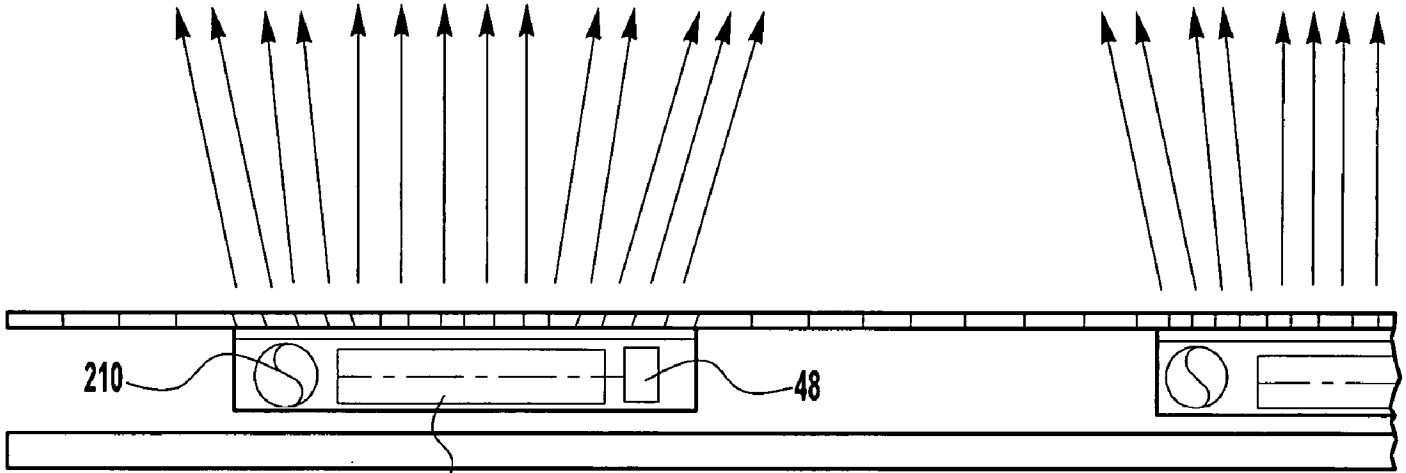
FIG. 7 is a side elevation view of the HVAC system shown in FIG. 6.

For example as shown in FIGS. 6–8, the system can utilize heated air (such as ducted or plenum air from a fan-coil or other heating source shown as duct 210). A conventional damper 200 is used to adjust the amount of plenum supply air flow introduced to the diffuser, and/or to mix with heated air. Furthermore, damper 200 can be used to stop air flow to the diffuser, resulting in natural convective heating (i.e., heating without external or supplied air flow); and, during low load conditions, the control of alternate damper sections can be sequenced to maintain elevated air flow rates (and thus room air induction) in active diffusers.

As best shown in FIG. 8, the first and second plates 44 and 46, respectively can be varied to obtain a notable number of effects. Starting at the top of FIG. 8 with position A, the first plate 44 and second plate 46 are both positioned at a 0% stroke position in which all segments of the apertures 60 and 62 of the first and second plates 44 and 46, respectively, are closed. In position B, the second plate 46 is moved to the right while the first plate 44 remains in position and a 25% stroke position is shown wherein lead segments 194 positioned toward the ends of the first and second plates 44 and 46, respectively, (where the apertures 62 are larger and the apertures 60 have more space there between) are partially opened (shaded area showing overlap of aperture 60 and aperture 62.) and plenum air is allowed to pass through the first and second plates 44 and 46.

In position C, the 50% stroke position, the openings 0 of the lead segments 194 are fully open and equal to the size of the aperture 60 in the first plate 44. In position D there is shown a 75% stroke position and all of the segments are at least partially open. In particular at position D, the lag segments 196 are partially open and the lead segments 194 remain fully open. Finally at position E, 100% actuator stroke has occurred and both the lead segments 194 and the lag segments 196 are all fully open.

Referring back to FIG. 1, system 10 includes a grille 22 which is provided on the top of system 10. Grille 22 is flush with floor panels 14 and covers system 10. Grille 22 allows for the passage or flow of air from system 10 to space 26. Grille 22 may be modified to provide directional control (such as by using vanes 172 having differing angles as shown in FIG. 4) which create laterally diverging air jets. One or more supports 112 may be provided transverse to the length of grille 22 for support as well as to assist in providing directional control of air flow.

Grille 22 provided over aperture sets 60 and 62 creates multiple paths for induction of room air, first perpendicularly between aperture sets 60 and 62, and second, laterally into the small low-pressure zones above individual grille bars 172 (see FIGS. 3 and 4). The induced air raises the temperature of the air jets and reduces the height of their vertical plumes. This maintains mixing in the occupied zone of the room, without disturbing a stratified overhead layer and yielding favorable room temperature gradients under a large range of cooling loads.

It should be appreciated that one advantage of the system shown is that the majority of the system may be installed after a raised floor has been installed. According to a particularly preferred embodiment, the system is sized to fit (in an integer width of a floor panel) between an edge of a floor panel and the exterior wall. The system may also be provided in any desired location having any planned width (including fractional widths of floor panels). Ventilation modules 40 and heating modules 80 may be dropped into the raised floor system. Heating modules 80 may be fitted with slide-type pipe supports to accept straight pipes with prefabricated finned segments. Solderless copper fittings may be used to connect to existing plumbing. Ventilation modules 40 would then be installed, and grilles 22 fixed in place. System 10 is advantageously configured for retrofit projects or applications.

System 10 provides an integrated solution to satisfy all building heating, ventilating and air conditioning needs through one linear floor grille assembly incorporating intermittent sections of variable-area, sliding-damper air supply inlets. This configuration assists in avoiding the energy cost and maintenance demands of under-floor fans and filters and reduces the number of components and floor plenum space involved. This configurations allows nighttime or emergency power mode perimeter heating without operating the primary under-floor air system or local fan-coils. Furthermore, it provides effective air diffusion employing nearly constant velocity under a variety of thermal loads, comfortable space conditions, a clean architectural appearance, and flexibility for open office relocations. The system reduces the number of mechanical and control components, their required space (plenum depth, floor area) and inopportune demands for access in the midst of office workstations. The system also offers "plug-and-play" features (mechanical or electronic) that simplify installation, a compact design, and a construction sequence that may shorten installation time and be well suited for retrofit projects.

It is also important to note that the construction and arrangement of the elements of the HVAC system as shown in the exemplary, preferred and alternative embodiments are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited.

For example, a variety of heating elements may be used (including electric heaters). The system is not limited to building perimeters and may also be applied in an architecturally integrated fashion to interior spaces, with or without heating involved. Other HVAC elements may be used in conjunction with the system including fan powered boxes, to increase peak heating and/or peak cooling capacities as the thermal loads of a building perimeter may require. The system also may use different grille widths as desired to suit thermal loads/exposures, and/or under-floor plenum pressure. Air deflection characteristics of the apertures, side deflectors and grille also may be selected to provide directional control.

Accordingly, all such modifications are intended to be included within the scope of the present inventions. Other substitutions, modifications, changes and omissions may be made in the design, operating conditions and arrangement of the preferred and other exemplary embodiments without departing from the spirit of the present invention.

We claim:

1. A system for modulating the flow of air to be supplied to a space, the system comprising:

a plenum for supplying pressurized air to the space;

a ventilation module having an upper area and a lower area, the ventilation module being in communication with the plenum for receiving the pressurized air from the plenum and conveying the pressurized air to the space;

a grille having at least one diffusing rib extending longitudinally along the grille, the grill being located proximate the upper area of the module for diffusing the pressurized air exiting the ventilation module into the space;

a first apertured plate located below the grille, the first apertured plate having a plurality of holes defining a gross aperture area exposed to the plenum for providing a flow of air; and wherein a hole of the plurality of holes has an aspect ratio different than one such that it has a longitudinal extent aligned substantially transverse to the longitudinal extent of the diffusing rib of the grille.

2. The system of claim 1, further comprising a second apertured plate located proximate the first apertured plate, the apertured plates being movable with respect to each other to define a net aperture area exposed to the plenum.

3. The system of claim 2, wherein the net aperture area is variable to affect the volume of air passing the apertured plates while maintaining a substantially constant velocity of the air passing the apertured plates.

4. The system of claim 1, wherein the first apertured plate comprises a first set of cross members, a second set of cross members, and a third set of cross members, each set of cross members having predetermined angles different than the other two sets of cross members.

5. A system for modulating the flow of air to be supplied to a space, the system comprising:

a plenum for supplying pressurized air to the space;

a ventilation module having an upper area and a lower area, the ventilation module being in communication with the plenum for receiving the pressurized air from the plenum and conveying the pressurized air to the space;

a grille located proximate the upper area of the module for diffusing the pressurized air exiting the ventilation module into the space;

a first apertured plate located below the grille, the first apertured plate having a plurality of holes defining a gross aperture area exposed to the plenum for providing a flow of air;

a second apertured plate located proximate the first apertured plate, the apertured plates being movable with respect to each other to define a net aperture area exposed to the plenum; and wherein the first and second apertured plates each have a lead aperture and a lag aperture; and further wherein at least the lead aperture in the second plate is larger than the lead aperture in the first plate.

6. The system of claim 2, further comprising an actuator connected to one of the first and second plates to move the plate for simultaneously modulating the flow from the apertured plates.

7. The system of claim 6, wherein the system maintains approximately constant air jet velocity and an elevated level of room air mixing through a large range of plenum air flow.

8. A system to modify the flow characteristics of a linear bar type supply air grille to enhance its performance when applied to a perimeter located, under-floor air distribution system, the system comprising:

a plenum for supplying pressurized air to the linear bar type supply air grille;

a ventilation module having an upper area and a lower area, the ventilation module being in communication with the plenum for receiving air from the plenum and conveying the air through the linear bar type supply air grille and to the space;

a first apertured plate located below the linear bar type supply air grille, the first apertured plate having a plurality of holes defining a gross aperture area exposed to the plenum for providing a constant velocity flow of air; and a second apertured plate located proximate the first apertured plate, the apertured plates being movable with respect to each other to define a net aperture area exposed to the plenum, wherein the first and second apertured plates each have a first aperture and a second aperture; and further wherein at least the first aperture in the second plate is larger than the first aperture in the first plate.

9. The system of claim 8, wherein the net aperture area is variable to affect the volume of air passing the apertured plates while maintaining a substantially constant velocity of the air passing the apertured plates.

10. The system of claim 8, wherein the grille is located proximate the upper area of the module for diffusing air exiting the ventilation module into the space and wherein the first apertured plate is fixedly located above the second apertured plate which is movable relative to the first apertured plate.

11. The system of claim 8, further comprising an actuator connected to second apertured plate to move the second apertured plate for modulating the flow from the apertured plates and further wherein the system maintains approximately constant air jet velocity and an elevated level of room air mixing through a large range of plenum air flow.

12. A system for passively inducing supplied air to increase the heating output of the system, the system comprising:

a heating module adapted to be located in a space, the heating module including a partition and a heating element, the heating module having a top open portion to allow heated air to flow;

a ventilation module for being located in a space, the ventilation module having an upper area and a lower area, the ventilation module adapted to be in communication with a plenum adapted for supplying pressurized air, wherein the ventilation module is designed to be juxtaposed the heating module;

a first apertured plate arranged in a plane and located in the ventilation module, the first apertured plate having a plurality of holes defining a gross aperture area exposed to the plenum for providing a constant velocity flow of air;

a second apertured plate located proximate the first apertured plate, the apertured plates being movable with respect to each other to define a net aperture area exposed to the plenum.

13. The system of claim 12, further comprising a second ventilation module located on an opposite side of the heating module from the first ventilation module.

14. The system of claim 13, wherein the second ventilation module comprises a first apertured plate located in the ventilation module, the first apertured plate having a plurality of holes defining a gross aperture area exposed to the plenum for providing a constant velocity flow of air and a second apertured plate located proximate the first apertured plate in the second ventilation module, the first and second apertured plates of the second ventilation module being movable with respect to each other to define a net aperture area exposed to the plenum.

15. The system of claim 13 further comprising an actuator connected to the first and second ventilation.

16. The system of claim 14 further comprising an actuator connected to the second plate of the first ventilation module and the second plate of the second ventilation module for controlling the net aperture area exposed to the plenum in each ventilation module.

17. The system of claim 12 wherein the heating module and the ventilation module each have a length greater than its width and wherein the heating module and the ventilation module have their lengths aligned and are adapted to be installed in an under-floor, perimeter location within a space.

18. The system of claim 17 further comprising a second ventilation module; and wherein the heating module and the first and second ventilation modules all have a length greater than their width and wherein the heating module and the first and second ventilation modules have their lengths aligned and are all adapted to be installed in an under-floor, perimeter location within a space wherein the heating module is located between the first and second ventilation modules.

19. The system of claim 10 wherein a first aperture in the second plate is located for early engagement with an aperture in the first plate.

* * * * *